US010782027B2

(12) United States Patent
Bruin-Slot et al.

(10) Patent No.: US 10,782,027 B2
(45) Date of Patent: Sep. 22, 2020

(54) COOKING APPLIANCE WITH USER-SELECTABLE SEAR FEATURE

(71) Applicant: WHIRLPOOL CORPORATION, Benton Harbor, MI (US)

(72) Inventors: Zachary J. Bruin-Slot, Baroda, MI (US); Robert S. Donarski, St. Joseph, MI (US); Karen M. Embury, Benton Harbor, MI (US); John P. Levandowski, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 311 days.

(21) Appl. No.: 15/786,074

(22) Filed: Oct. 17, 2017

(65) Prior Publication Data

US 2019/0113239 A1 Apr. 18, 2019

(51) Int. Cl.
*F24C 7/08* (2006.01)

(52) U.S. Cl.
CPC ..... *F24C 7/085* (2013.01); *F24C 7/08* (2013.01); *F24C 7/086* (2013.01)

(58) Field of Classification Search
CPC ..... F24C 7/089; F24C 7/08; F24C 7/085
USPC ..... 99/327, 339; 219/392, 494, 502, 622, 219/632
See application file for complete search history.

(56) References Cited

U.S. PATENT DOCUMENTS

| | | | | |
|---|---|---|---|---|
| 5,044,262 | A | 9/1991 | Burkett et al. | |
| 7,964,824 | B2 | 6/2011 | Moon | |
| 9,191,988 | B2 | 11/2015 | Hegedis et al. | |
| 9,226,343 | B2 | 12/2015 | Moon et al. | |
| 9,560,928 | B2 | 2/2017 | Parrish et al. | |
| 2004/0245240 | A1* | 12/2004 | Cretors | H05B 1/0252 219/494 |
| 2006/0081597 | A1 | 4/2006 | Haberkamm | |
| 2010/0015314 | A1* | 1/2010 | Patel | A47J 36/025 426/523 |
| 2010/0196561 | A1 | 8/2010 | Kling et al. | |
| 2013/0092145 | A1* | 4/2013 | Murphy | F24C 7/085 126/21 R |
| 2013/0146581 | A1 | 6/2013 | Donarski et al. | |
| 2015/0028022 | A1 | 1/2015 | Moon et al. | |
| 2016/0174298 | A1 | 6/2016 | Moon et al. | |
| 2017/0253414 | A1* | 9/2017 | Linton | H05B 6/6494 |

FOREIGN PATENT DOCUMENTS

| | | | |
|---|---|---|---|
| WO | 2013059080 | A2 | 4/2013 |
| WO | 2017122177 | A1 | 7/2017 |

* cited by examiner

*Primary Examiner* — Thien S Tran
(74) *Attorney, Agent, or Firm* — Price Heneveld LLP

(57) ABSTRACT

A cooking appliance is provided herein. A heating element is configured to generate heat for cooking a food item. A user interface is configured to allow selection of a cooking program for cooking the food item and includes a sear feature that is selectable while a selected cooking program is underway. Selection of the sear feature increases a cooking temperature to a maximum cooking temperature without otherwise interrupting the selected cooking program that is underway.

18 Claims, 3 Drawing Sheets

COOKING APPLIANCE WITH USER-SELECTABLE SEAR FEATURE

FIELD OF THE DISCLOSURE

The present disclosure generally relates to a cooking appliance with a selectable sear feature, and more particularly, to a cooking appliance having a touchscreen user interface for displaying the sear feature and allowing selection of the sear function via a touch event.

BACKGROUND OF THE DISCLOSURE

Some cooking appliances such as ovens have means for allowing a user to increase a cooking temperature to sear a food item. However, in order to implement a sear, conventional cooking appliances may require the user to exit a currently selected cooking program or manually adjust the cooking temperature. This is not only inconvenient, but also time consuming. Accordingly, there is a need for a cooking appliance with a sear feature that may be implemented without having to exit a currently selected cooking program. The present disclosure is intended to satisfy this need.

SUMMARY OF THE DISCLOSURE

According to one aspect of the present disclosure, a cooking appliance is provided. A heating element is configured generate heat for cooking a food item. A user interface is configured to allow selection of a cooking program for cooking the food item and includes a sear feature that is selectable while a selected cooking program is underway. Selection of the sear feature increases a cooking temperature to a maximum cooking temperature without otherwise interrupting the selected cooking program that is underway.

According to another aspect of the present disclosure, a user interface of a cooking appliance is provided. A touchscreen displays information related to a cooking program that is underway. A sear feature is displayed on the touchscreen and is selectable while the cooking program is underway. Selection of the sear feature increases a cooking temperature to a maximum cooking temperature without otherwise interrupting the cooking program that is underway.

According to yet another aspect of the present disclosure, a cooking method is provided and includes the steps of: providing a touchscreen on a cooking appliance that allows selection of a cooking program for cooking a food item; displaying a sear feature that is selectable while the cooking program is underway and without having to exit a current screen of the touchscreen, the current screen configured to display information related to the selected cooking program; registering selection of the sear feature; and increasing a cooking temperature to a maximum cooking temperature without otherwise interrupting the cooking program that is underway.

These and other aspects, objects, and features of the present disclosure will be understood and appreciated by those skilled in the art upon studying the following specification, claims, and appended drawings.

DETAILED DESCRIPTION OF THE PREFERRED EMBODIMENTS

As required, detailed embodiments of the present disclosure are provided herein. However, it is to be understood that the disclosed embodiments are merely exemplary and may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the teachings of the present disclosure.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Figure 1:
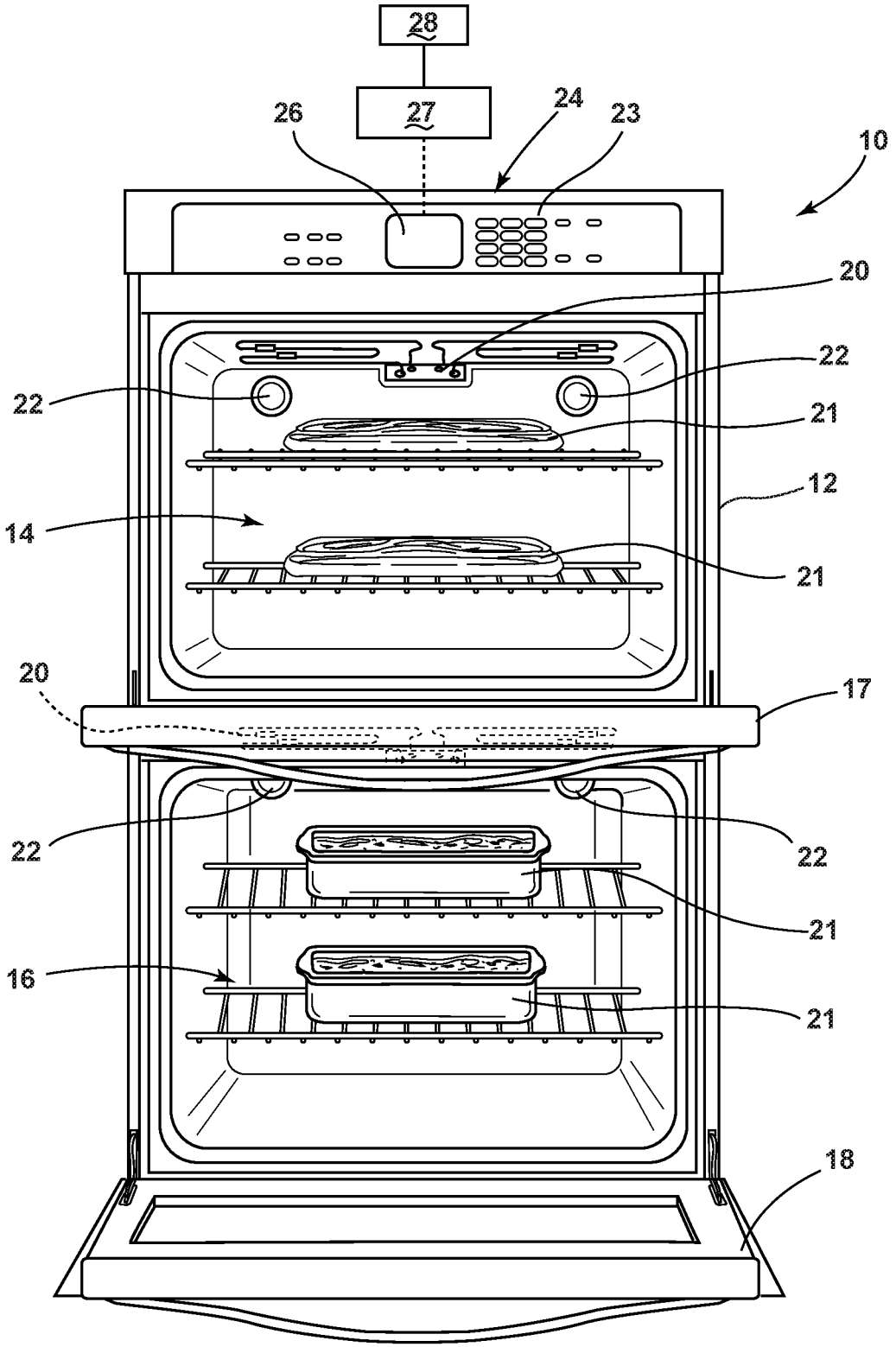
FIG. 1 illustrates a cooking appliance embodied as a double oven and having a user interface that includes a touchscreen.

Referring to FIG. 1, a cooking appliance 10 is exemplarily shown as a double oven. The cooking appliance 10 includes a cabinet 12 defining at least one cooking cavity shown as a first cooking cavity 14 and a second cooking cavity 16. The first and second cooking cavities 14, 16 are accessible through corresponding hinged doors 17, 18 and contain one or more heating elements 20 for generating heat to cook food items 21. The heating elements 20 may be conventional heating elements located on a floor, ceiling, and/or wall of the respective first and second cooking cavities 14, 16. One or more lights 22 may be provided in the first and second cooking cavities 14, 16 to allow a user to see the contents thereof. The cooking appliance 10 also includes a control panel 23 having a user interface 24 configured to allow selection of a cooking program for cooking food items 21 in the first and/or second cooking cavities 14, 16. While the cooking appliance 10 is described herein as a double oven, it will be appreciated that the cooking appliance 10 may also include a traditional single oven, a cooktop, a cooktop griddle, a barbeque grill, or any other cooking appliance configured to apply heat to food items.

In the depicted embodiment, the user interface 24 includes a touchscreen 26 in communication with a processor 27 operably coupled to the heating elements 20 of the first and second cooking cavities 14, 16. The touchscreen 26 is configured to display a variety of menus and options thereon to enable a user to select a cooking program for the first and/or second cooking cavities 14, 16. In turn, the processor 27 executes the selected cooking program by controlling one or more heating elements 20 in the specified first and/or second cooking cavities 14, 16. To monitor the cooking temperature inside the first and second cooking cavities 14, 16, the processor 27 may receive temperature information from a temperature sensor 28.

Figure 2:
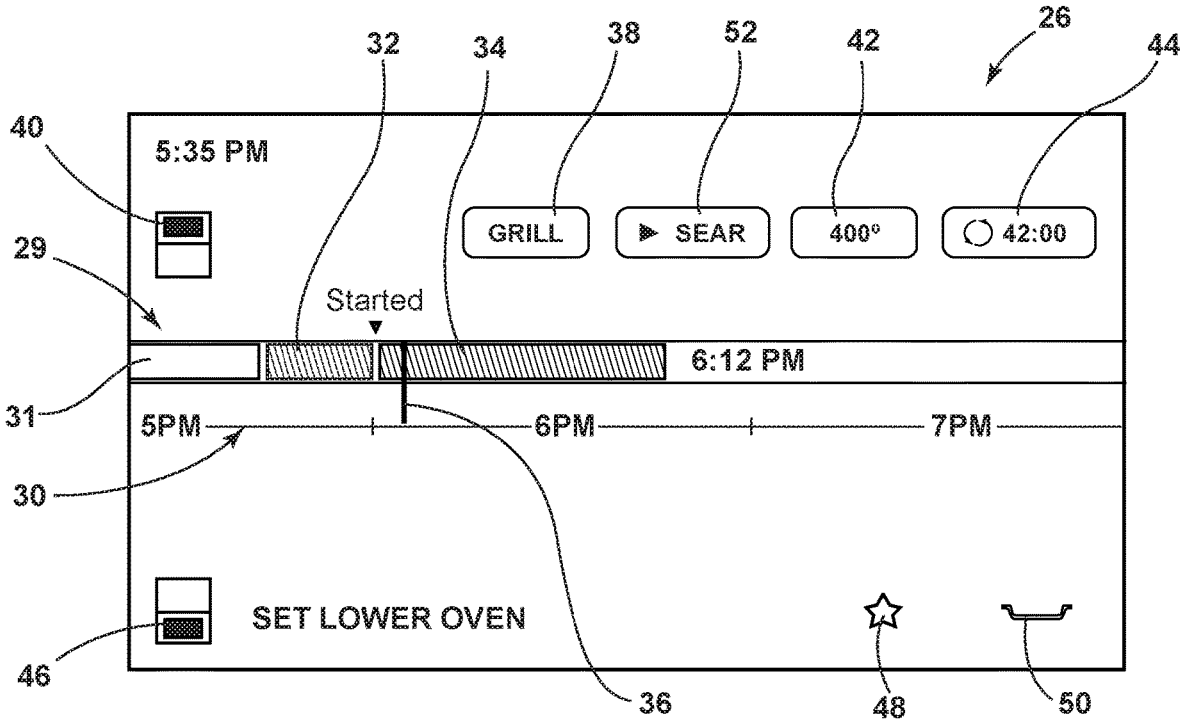
FIG. 2 illustrates the touchscreen displaying information related to a cooking program selected by a user and a selectable sear feature.

Referring to FIG. 2, the touchscreen 26 is shown displaying a progress bar 29 positioned relative a timeline 30. The progress bar 29 visually indicates one or more stages of a cooking program selected by the user in a previous menu. In the depicted embodiment, the progress bar 29 includes an idle stage 31, a preheating stage 32, and a grill stage 34. The respective stages 31-34 may be illustrated as separate segments and may be color coded to distinguish therebetween. A progress indicator 36 spans across the progress bar 29 and timeline 30 in real time to notify the user of the current stage and visually relate the progress bar 29 to the timeline 30 so that the user can quickly track the progress of the selected cooking program. In the depicted embodiment, the current stage corresponds to the grill stage 34 as indicated by virtual icon 38. As shown, the grill stage 34 began at approximately 5:30 PM and is set to end at 6:12 PM.

With continued reference to FIG. 2, the touchscreen 26 is also configured to display other information related to the selected cooking program. For example, virtual icon 40 indicates the specified cooking cavity (e.g., cooking cavity 14) in which the cooking program is executed. Virtual icon 42 indicates a current cooking temperature (e.g., 400° F.) inside the specified cooking cavity and virtual icon 44 indicates a duration (e.g., 42:00) in minutes and seconds for the current stage, or alternatively, the selected cooking program. The current time (e.g., 5:35 PM) may be displayed in the upper left corner of the touchscreen 26. Virtual icon 46 enables the user to specify a cooking program for an unselected cooking cavity (e.g., cooking cavity 16) and virtual icon 48 enables the user to save the current cooking program to favorites. Virtual icon 50 enables the user to navigate to a home screen or other menu. The user may interact with virtual icons 46-50 by simply touching the virtual icons 46-50 and following prompts or instructions presented on another screen or sub-screen. It is contemplated that the various stages of the cooking program and the corresponding cooking temperatures and durations may be specified by the user in a previous menu screen, for example, prior to the commencement of the selected cooking program.

With further reference to FIG. 2, a sear feature shown as virtual icon 52 is selectable while the selected cooking program is underway. Alternatively, the sear feature may be configured as a button or other known user-input device located on the control panel 23. The selection of the sear feature increases a cooking temperature inside the specified cooking cavity to a maximum cooking temperature without otherwise interrupting the selected cooking program that is underway. That is, except for an increase in cooking temperature, the grill stage 34 is unaffected by the selection of the sear feature and retains its duration, as previously specified by the user. Advantageously, the sear feature is selectable without having to exit the current screen of the touchscreen 26. To select the sear feature, the user simply touches virtual icon 52, and in response to the touchscreen 26 registering the touch event, the processor 27 operates one or more heating elements in the specified cooking cavity so as to increase the cooking temperature therein to the maximum cooking temperature.

Figure 3:
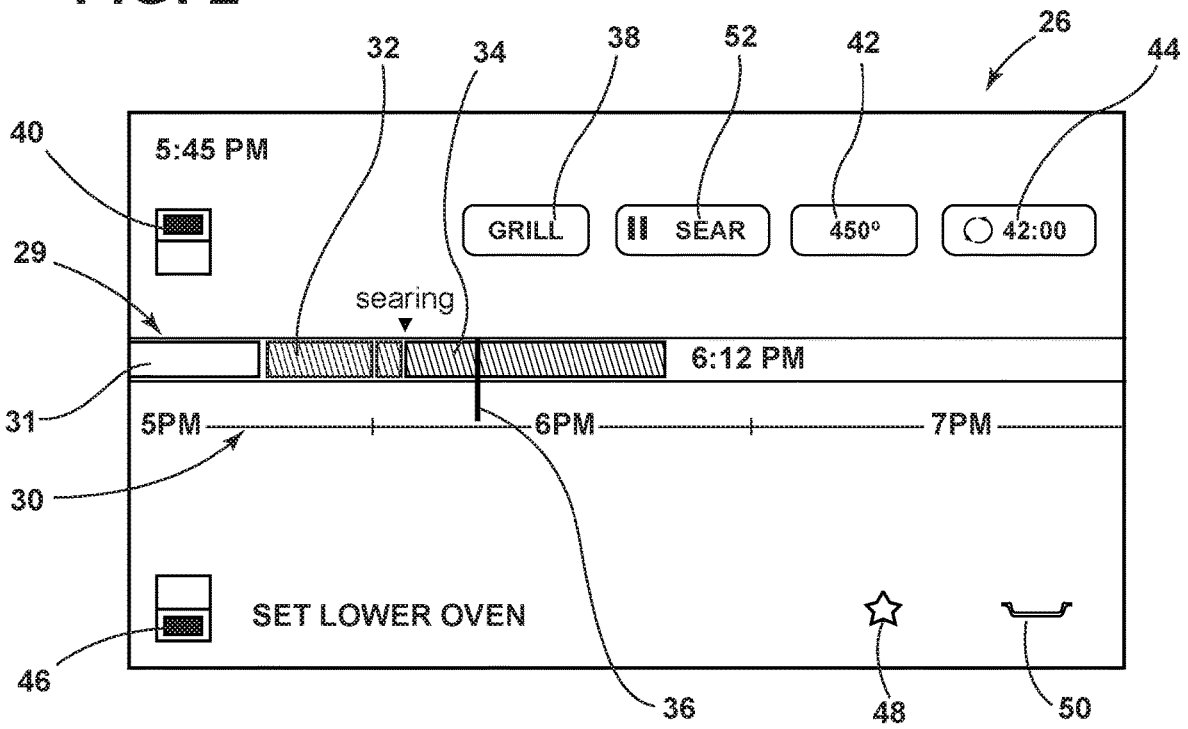
FIG. 3 illustrates the sear feature in progress.

Referring to FIG. 3, selection of the sear feature at 5:35 PM results in the word "searing" appearing above the progress indicator 36 at that time to further reinforce that the sear feature has been selected. In the depicted embodiment, the change in the current time has resulted in the progress indicator 36 moving further along the progress bar 29. Additionally, due to the selection of the sear feature, the cooking temperature inside the specified cavity has increased to 450° F. as indicated by virtual icon 42.

Figure 4:
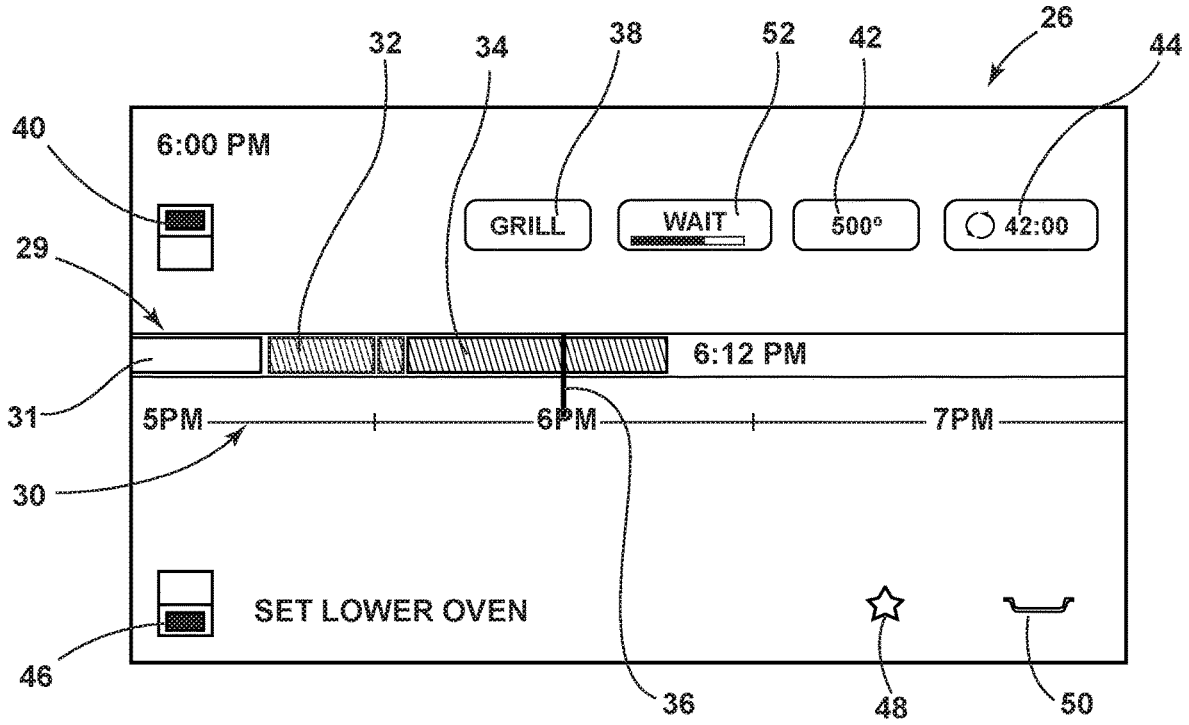
FIG. 4 illustrates the sear feature and selection thereof being disabled.

Referring to FIG. 4, the maximum cooking temperature is reached at approximately 6:00 PM. In the depicted embodiment, the maximum cooking temperature corresponds to 500° F., which has been arbitrarily chosen for purposes of illustration and not limitation. Thus, it is to be understood that the maximum cooking temperature may correspond to other temperatures above or below 500° F. It is further contemplated that the maximum cooking temperature may be predetermined by the user based on allowable ranges set by the manufacturer of the cooking appliance 10. Upon reaching the maximum cooking temperature, the sear feature and selection thereof becomes disabled and the user must temporarily wait before selecting the sear feature again. As shown, a progress bar 54 or timer may appear in virtual icon 52 indicating the amount of time remaining before the sear feature becomes available.

Alternatively, the sear feature and selection thereof may be temporarily disabled after a predetermined time period regardless of whether the maximum cooking temperature is reached. Alternatively still, the sear feature and selection thereof may be temporarily disabled if the processor 27 determines that the cooking temperature inside the specified cooking cavity exceeds an allowable temperature threshold based on temperature information supplied by the temperature sensor 28. Alternatively still, the sear feature may be temporarily disabled based on user-input provided via the user interface 24. Once the sear feature becomes disabled, the cooking temperature in the specified cavity is returned to a pre-sear level while the selected cooking program continues to runs its course. For example, the cooking temperature in the specified cavity may return to 400° F. as the grill stage 34 continues to completion. Assuming there is sufficient time left in the selected cooking program, the user may once again select the sear function after it becomes available.

Modifications of the disclosure will occur to those skilled in the art and to those who make or use the disclosure. Therefore, it is understood that the embodiments shown in the drawings and described above are merely for illustrative purposes and not intended to limit the scope of the disclosure, which is defined by the following claims as interpreted according to the principles of patent law, including the doctrine of equivalents.

It will be understood by one having ordinary skill in the art that construction of the described disclosure, and other components, is not limited to any specific material. Other exemplary embodiments of the disclosure disclosed herein may be formed from a wide variety of materials, unless described otherwise herein.

For purposes of this disclosure, the term "coupled" (in all of its forms: couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature, or may be removable or releasable in nature, unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the cooking appliance may be varied, and the nature or numeral of adjustment positions provided between the elements may be varied. It should be noted that the elements and/or assemblies of the cooking appliance may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes, or steps within described processes, may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further, it is to be understood that such concepts are intended to be covered by the following claims, unless these claims, by their language, expressly state otherwise. Further, the claims, as set forth below, are incorporated into and constitute part of this Detailed Description.

What is claimed is:

1. A cooking appliance comprising:

a heating element configured to generate heat for cooking a food item; and a user interface configured to allow selection of a cooking program for cooking the food item, the user interface comprising:

a sear feature that is selectable while a selected cooking program is underway, wherein selection of the sear feature increases a cooking temperature during the selected cooking program to a maximum cooking temperature without otherwise interrupting the selected cooking program that is underway including at least a duration of the selected cooking program, wherein the sear feature and selection thereof is disabled upon reaching the maximum cooking temperature and the user interface is configured to instruct a user to temporarily wait before selecting the sear feature again, and wherein a progress bar indicates an amount of time remaining before the sear feature becomes available again.

2. The cooking appliance of claim 1, wherein the user interface comprises a touchscreen and the sear feature comprises a virtual icon displayed on the touchscreen and selectable via a touch event, and wherein the sear feature is selectable without having to exit a current screen of the touchscreen, the current screen displaying information related to the selected cooking program that is underway.

3. The cooking appliance of claim 1, wherein once the sear feature becomes disabled, the cooking temperature is returned to pre-sear levels while the selected cooking program continues to runs its course.

4. The cooking appliance of claim 1, wherein the sear feature and selection thereof is temporarily disabled after a predetermined time period regardless of whether the maximum cooking temperature is reached.

5. The cooking appliance of claim 1, wherein the sear feature and selection thereof is temporarily disabled based on the cooking temperature exceeding an allowable temperature threshold.

6. The cooking appliance of claim 1, wherein the sear feature and selection thereof is temporarily disabled based on user-input provided via the user interface.

7. A user interface of a cooking appliance, comprising:

a touchscreen displaying information related to a cooking program that is underway;

a progress bar displayed on the touchscreen, the progress bar indicating one or more cooking stages for the cooking program;

a sear feature displayed on the touchscreen and selectable while the cooking program is underway, wherein selection of the sear feature increases a cooking temperature to a maximum cooking temperature without otherwise interrupting the cooking program that is underway; and a searing indicator displayed on the touchscreen proximate the progress bar, the searing indicator denoting the selection of the sear feature relative to the one or more cooking stages of the cooking program.

8. The user interface of claim 7, wherein the sear feature comprises a virtual icon selectable without having to exit a current screen of the touchscreen, the current screen displaying information related to a selected cooking program.

9. The user interface of claim 7, wherein the selection of the sear feature is disabled upon reaching the maximum cooking temperature, and wherein the touchscreen is configured to instruct a user to temporarily wait before selecting the sear feature again, and wherein the progress bar of the touchscreen indicates an amount of time remaining before the sear feature becomes available again.

10. The user interface of claim 7, wherein the selection of the sear feature is temporarily disabled after a predetermined time period regardless of whether the maximum cooking temperature is reached.

11. The user interface of claim 7, wherein the selection of the sear feature is temporarily disabled based on at least one of the cooking temperature exceeding an allowable temperature threshold and a user-input provided via said user interface.

12. A cooking method comprising:

providing a touchscreen on a cooking appliance that allows selection of a cooking program for cooking a food item;

displaying a sear feature that is selectable while a selected cooking program is underway and without having to exit a current screen of the touchscreen, the current screen configured to display information related to the selected cooking program;

heating the cooking appliance to a first temperature based on the selected cooking program;

registering selection of the sear feature;

increasing a cooking temperature to a maximum cooking temperature without otherwise interrupting the selected cooking program that is underway; and completing the selected cooking program at the first temperature.

13. The cooking method of claim 12, further comprising the step of disabling the sear feature and selection thereof upon reaching the maximum cooking temperature, wherein upon disabling the sear feature, the cooking temperature is returned to pre-sear levels.

14. The cooking method of claim 13, further comprising the step of instructing a user to temporarily wait before selecting the sear feature again and indicating an amount of time remaining before the sear feature becomes available.

15. The cooking method of claim 12, further comprising the step of temporarily disabling the sear feature and selection thereof after a predetermined time period regardless of whether the maximum cooking temperature is reached.

16. The cooking method of claim 12, further comprising the step temporarily disabling the sear feature and selection thereof based on the cooking temperature exceeding an allowable temperature threshold.

17. The cooking method of claim 12, further comprising the step of temporarily disabling the sear feature and selection thereof based on user-input.

18. The user interface of claim 7, further comprising:

a clock timeline displayed on the touch screen proximate the progress bar; and a visual indicator configured to span across the progress bar and the clock timeline as the cooking program progresses through the one or more cooking stages.

* * * * *